US007510094B1

(12) United States Patent
Willis et al.

(10) Patent No.: US 7,510,094 B1
(45) Date of Patent: Mar. 31, 2009

(54) CHILD RESISTANT ONE PIECE PUSH AND TURN CLOSURE

(75) Inventors: Clifton C. Willis, Evansville, IN (US); Mark K. Branson, Newburgh, IN (US)

(73) Assignee: Rexam Closures and Containers Inc., Evansville, IN (US)

( * ) Notice: Subject to any disclaimer, the term of this patent is extended or adjusted under 35 U.S.C. 154(b) by 465 days.

(21) Appl. No.: 11/028,939

(22) Filed: Jan. 4, 2005

(51) Int. Cl.
*B65D 55/02* (2006.01)

(52) U.S. Cl. ..... 215/218

(58) Field of Classification Search ..... 215/252, 215/45, 44, 43, 344, 332, 223, 222, 219, 215/218, 217, 350, 349, 331, 330, 329; 220/288, 220/300, 298, 296, 293
See application file for complete search history.

(56) References Cited

U.S. PATENT DOCUMENTS

| | | | | | |
|---|---|---|---|---|---|
| 133,518 | A | * | 12/1872 | Burnap | 215/332 |
| 1,843,559 | A | * | 2/1932 | Hornsey | 220/288 |
| 2,009,666 | A | * | 7/1935 | Keith | 215/334 |
| 2,056,947 | A | * | 10/1936 | Baechle | 220/258.3 |
| 2,153,426 | A | * | 4/1939 | McNamara et al. | 215/252 |
| 2,529,817 | A | * | 11/1950 | Russell | 222/556 |
| 3,204,800 | A | * | 9/1965 | Bugla et al. | 215/223 |
| 3,361,290 | A | * | 1/1968 | Matthews et al. | 220/296 |
| 3,402,842 | A | * | 9/1968 | Millian | 215/217 |
| 3,435,978 | A | * | 4/1969 | Wittwer | 215/217 |
| 3,559,832 | A | * | 2/1971 | Balducci | 215/223 |
| 3,587,896 | A | * | 6/1971 | Graff | 215/206 |
| 3,716,161 | A | | 2/1973 | Julian et al. | |
| 3,733,001 | A | | 5/1973 | Gach | |
| 3,734,332 | A | * | 5/1973 | Grulich | 215/208 |
| 3,782,574 | A | * | 1/1974 | Rumble | 215/223 |
| 4,006,837 | A | * | 2/1977 | Gates et al. | 215/340 |
| 4,098,419 | A | * | 7/1978 | Virog et al. | 215/252 |
| 4,159,779 | A | * | 7/1979 | Hedgewick | 215/214 |
| 4,319,690 | A | * | 3/1982 | Birrell et al. | 215/220 |

(Continued)

FOREIGN PATENT DOCUMENTS

DE 3919578 A1 * 11/1990

*Primary Examiner*—Anthony D Stashick
*Assistant Examiner*—Robert J Hicks
(74) *Attorney, Agent, or Firm*—Chad D. Bruggeman; Middleton Reutlinger

(57) ABSTRACT

A closure having a top wall, an annular side wall depending downwardly from the top wall defining an open bottom, an optional internal thread projecting inwardly from the inner annular surface of the annular side wall, and at least two lugs or two slots in a thread wherein the at least two lugs extend inward from the inner annular surface and at least one lug has a different arc length and at least one of the at least two slots in a thread is of a different arc length. A container having a neck with an outer annular surface with either an external thread projecting outwardly wherein at least two notches are in the thread and each of the notches vertically align with an aligning lug in a closure when the closure is in a sealing position on the container neck, each of the notches have an arc length greater than the arc length of the aligning lug, the at least two notches in a thread on a container neck has at least one notch of a different arc length, and a spring mechanism providing a separating force between the closure and container.

16 Claims, 14 Drawing Sheets

U.S. PATENT DOCUMENTS 4,394,916 A * 7/1983 Smalley ..... 215/220
4,573,598 A * 3/1986 Perry ..... 215/204
4,583,653 A * 4/1986 Minsky ..... 220/300
5,533,633 A * 7/1996 King ..... 215/252
5,791,504 A * 8/1998 Hofmann et al. ..... 215/223
6,006,930 A * 12/1999 Dreyer et al. ..... 215/44
6,015,054 A * 1/2000 King et al. ..... 215/252
6,227,391 B1 * 5/2001 King ..... 215/307
6,378,713 B2 4/2002 Montgomery
6,866,164 B2 * 3/2005 Branson et al. ..... 222/153.14
7,055,708 B1 * 6/2006 Haffner et al. ..... 215/222
2005/0000931 A1 * 1/2005 Bosl et al. ..... 215/252
2005/0145629 A1 * 7/2005 Herr ..... 220/293
2005/0199572 A1 * 9/2005 Brozell ..... 215/218
2005/0236354 A1 * 10/2005 Miceli et al. ..... 215/228
2005/0252877 A1 * 11/2005 Moller ..... 215/222
2005/0269280 A1 * 12/2005 Konefal et al. ..... 215/228

* cited by examiner

CHILD RESISTANT ONE PIECE PUSH AND TURN CLOSURE

CROSS-REFERENCE TO RELATED APPLICATIONS

Not applicable.

STATEMENT REGARDING FEDERALLY SPONSORED RESEARCH OR DEVELOPMENT

Not applicable.

FIELD OF INVENTION

The present invention relates to a safety closure and container combination and in particular to push and turn child resistant one piece closure and container combinations.

BACKGROUND OF THE INVENTION

The use of cooperating locking lugs on safety closures and containers to prevent children from gaining access to the contents of the container is well known in the prior art. Drugs, corrosive products, and antifreeze are examples of substances that are commonly packaged in containers or bottles having child-resistant closures. The closures and their complementary containers are designed to allow the user to open the container without allowing a child to open the same. For example, the user may squeeze the sides of the closure to release one or more locking lugs on the closure from corresponding locking lugs on the bottle neck. Typically, this type of closure has locking lugs on the closure and on the bottle neck that are sufficiently long that the lugs interact at least a second time as the closure is twisted open thereby preventing the user from rotating the closure any further without an additional unlocking action.

Safety closures are often provided including a flexible annular skirt having an inner annular surface thereof and a pair of opposed locking lugs projecting inwardly therefrom. A container for this type of closure has a neck portion having on an exterior surface a pair of opposed, outwardly-projecting locking lugs. The safety closure of this type is threadingly engageable on the container neck portion until the closure locking lugs pass over and beyond their respective cooperating container locking lugs, thereby causing interference therebetween and preventing removal rotation of the safety closure relative to the container neck. Removal of the safety closure from the container neck requires an individual to first overcome the interference between the cooperating locking lugs and to then concurrently apply sufficient removal rotation to the safety closure relative to the container A push-and-turn system, typically used for pill containers, requires that the closure or cap for the pill container be pushed axially downwardly and rotated at the same time. Examples of "push-and-turn" closures are disclosed in U.S. Pat. No. 4,319,690, issued to Birrell et al. on Mar. 16, 1982, and U.S. Pat. No. 4,394,916, issued to Smalley on Jul. 26, 1983. These patents teach typical two-piece ramp and lug closures. Essentially the closure comprises an inner cap and an outer cap which are rotatably attached to one another. A plurality of lugs on one cap project towards a plurality of corresponding ramps on the opposite cap. Generally, the ramps and lugs engage each other when turned in a fastening direction such that the two caps turn in tandem. However, when the cap is rotated in an unfastening direction, the lugs tend to slide over the ramps. The outer cap turns freely from the inner cap, and the inner cap remains fastened to the container. In order to open the cap, the outer cap must be pushed downward in order to counteract the tendency of the lugs to slide over the ramps while the cap is being turned.

Another type of safety closure is taught in U.S. Pat. No. 3,716,161, issued to Julian et al. on Feb. 13, 1973. Julian et al. teaches a bayonet-type closures in which one of the closure and the container has a set of bayonet lugs and the other has a set of mating lugs so that it is necessary to urge the closure toward the container against a biasing means while applying a rotative force in order to disengage the bayonet lugs from the mating lugs to remove the closure from the container.

Each of the child resistant containers and corresponding enclosures found in the prior art are such that they must be used in combination with one another or it is economically prohibitive to interchange either the container or closure with a differently designed container or closure. This creates problems with production and inventory of containers and corresponding closures. Therefore, it is an object of the present invention to provide a safety closure and container combination wherein the closure and container may be interchanged with other existing closures and containers. Other objectives reached by the present invention will become apparent in the following descriptions.

SUMMARY OF THE INVENTION

The present invention relates to a closure and container combination wherein the container neck has notches in a thread or lugs of specific size and orientation that line up with the other of lugs or notches in the other part of the combination upon fully engaging the closure onto the container. When the closure is fully engaged onto the container a spring or lift mechanism on the closure biases the closure away from the container and lifts the lugs into the notches thus providing a push and turn child resistant closure.

The closure and/or container are interchangeable with existing closures and/or containers thus solving many production and inventory problems associated with the prior art. When a closure of the present invention having lugs is engaged with a container of the prior art having a standard thread design, the lugs cooperate with the thread on the container and provide a sealing engagement. When a closure of the present invention having slots in a thread is engaged with a container of the prior art having a standard thread design, the slotted thread cooperates with the thread on the container and provides a sealing engagement. The corresponding container embodiments of the present invention provide interchangeability in a like manner. This interchangeability between the closures and containers of the present invention and closures and containers of the prior art relieves much of the production and inventory problems associated with the prior art by not requiring a specific container to be used with a specific closure.

The presently claimed device comprises a closure having a top wall and an annular skirt depending from the top wall. An embodiment of the closure has a thread extending helically about the inner surface of the annular skirt of the closure. In one embodiment, the closure thread has a first and second lug or projection extending from the thread toward the top wall. The first and second lugs have varying arc lengths and are specifically located about the inner circumference of the annular skirt. This arrangement provides specifically sized and spatially oriented lugs about the inner surface of the annular skirt. A container neck is further provided having a container thread helically extending about the neck. The container thread has a plurality of notches or slots corresponding to the closure lugs wherein first and second slots have varying arc lengths that are spatially located on an outside surface of the container neck so that when the closure is in a sealing position on the container the notches and lugs line up with one another. The aligning notches in the container thread have a slightly larger arc length than the aligning lug so that the lugs seat into the aligning notches upon sealing the closure onto the container. The lugs and notches or slots provide on-stop and off-stop or a child resistant feature to the closure and container combination.

DETAILED DESCRIPTION OF THE PREFERRED EMBODIMENTS

The present invention relates to a closure and container combination intended for use as a child-resistant closure wherein the closure and container have annular surfaces with mating threads and/or lugs. In one embodiment, one mating thread has lugs while the other mating thread has notches or slots that align with the lugs when the closure is in a sealing position on the container. The slots or notches each have a specific arc length that is slightly greater than the arc length of the aligning lug thus allowing the lugs to seat in the aligning slots only when the closure is in a sealing position. Additionally, at least two of the slots or notches have different arc lengths so that the lugs will not seat into a slot or notch until the closure is in a sealing position.

The lugs and slots depicted in the various Figures are selected solely for the purpose of illustrating the invention. Other and different closures and containers may utilize the inventive features described herein. Reference to the Figures showing an embodiment of the presently claimed invention is made to describe the presently claimed invention and not to limit the scope of the claims and disclosure herein.

Figure 1:
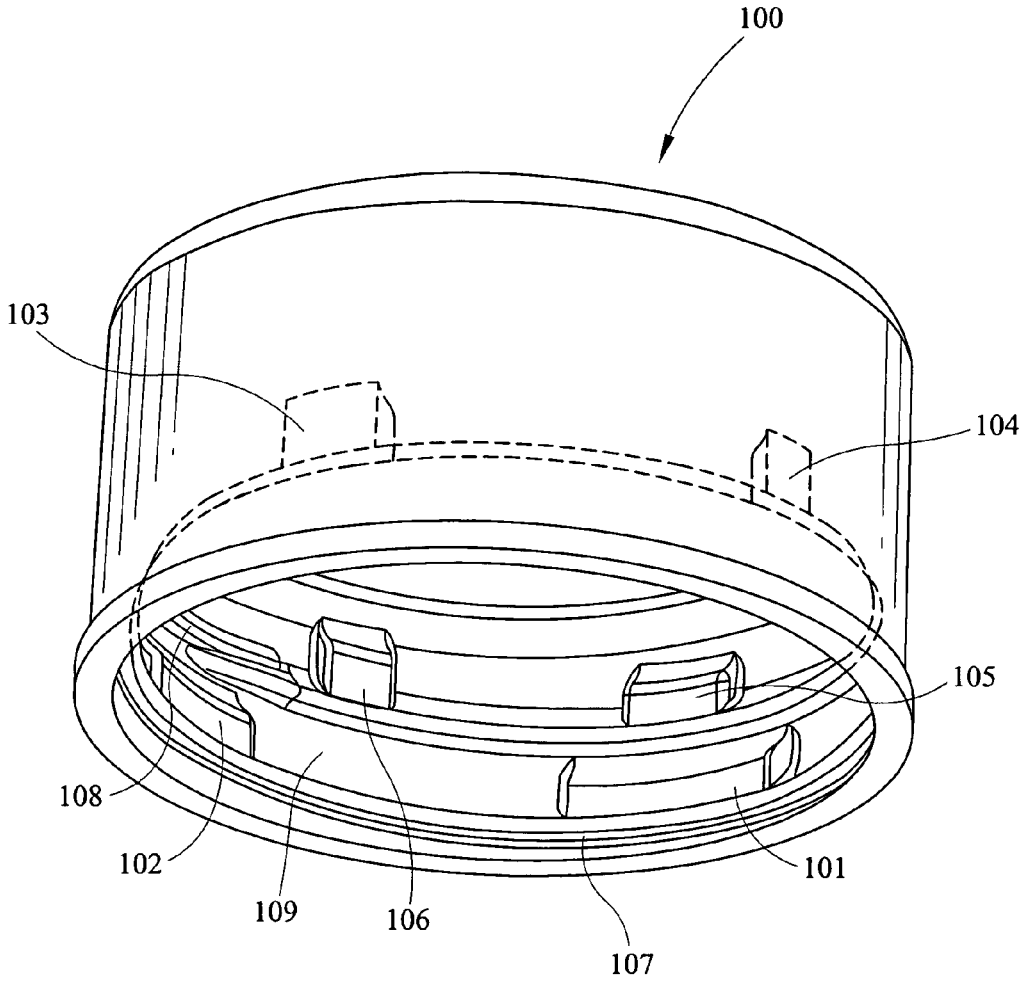
FIG. 1 is a perspective view of an embodiment of the closure of the present invention showing lugs of specific size and orientation in relation to a thread.

FIG. 1 shows a perspective view of an embodiment of closure 100 of the presently claimed invention showing lugs 101, 102, 103, 104, and 105 of specific size and orientation in relation to the helical thread 107 on inner annular surface 109. Lug 101 may be optionally provided to act as an off-stop when closure is in a sealing position on container 500. An off-stop provides a means of retaining a closure in a sealing position on a container. Lugs 102-105 have specific arc lengths and orientations on inner annular surface 109. The arc lengths and circumferential positions of lugs 102-105 on inner annular surface 109 vary so that they vertically align with a notch in a thread on container 500. The lugs 102-105 are of varying sizes so that they will not seat in a vertically aligned notch until the closure 100 is in a sealing position on container 500. When closure 100 is in a sealing position on container 500, lugs 102-105 seat in notches in one or a plurality of threads on container 500 or 1200 providing for on-stop and off-stop functionality. An on-stop prevents a closure from being over tightened on a container. Lug 106 provides for an additional on-stop feature. Liner retention bead 108 may also optionally be provided to hold an optional disk spring and/or liner in closure 100.

Figure 2:
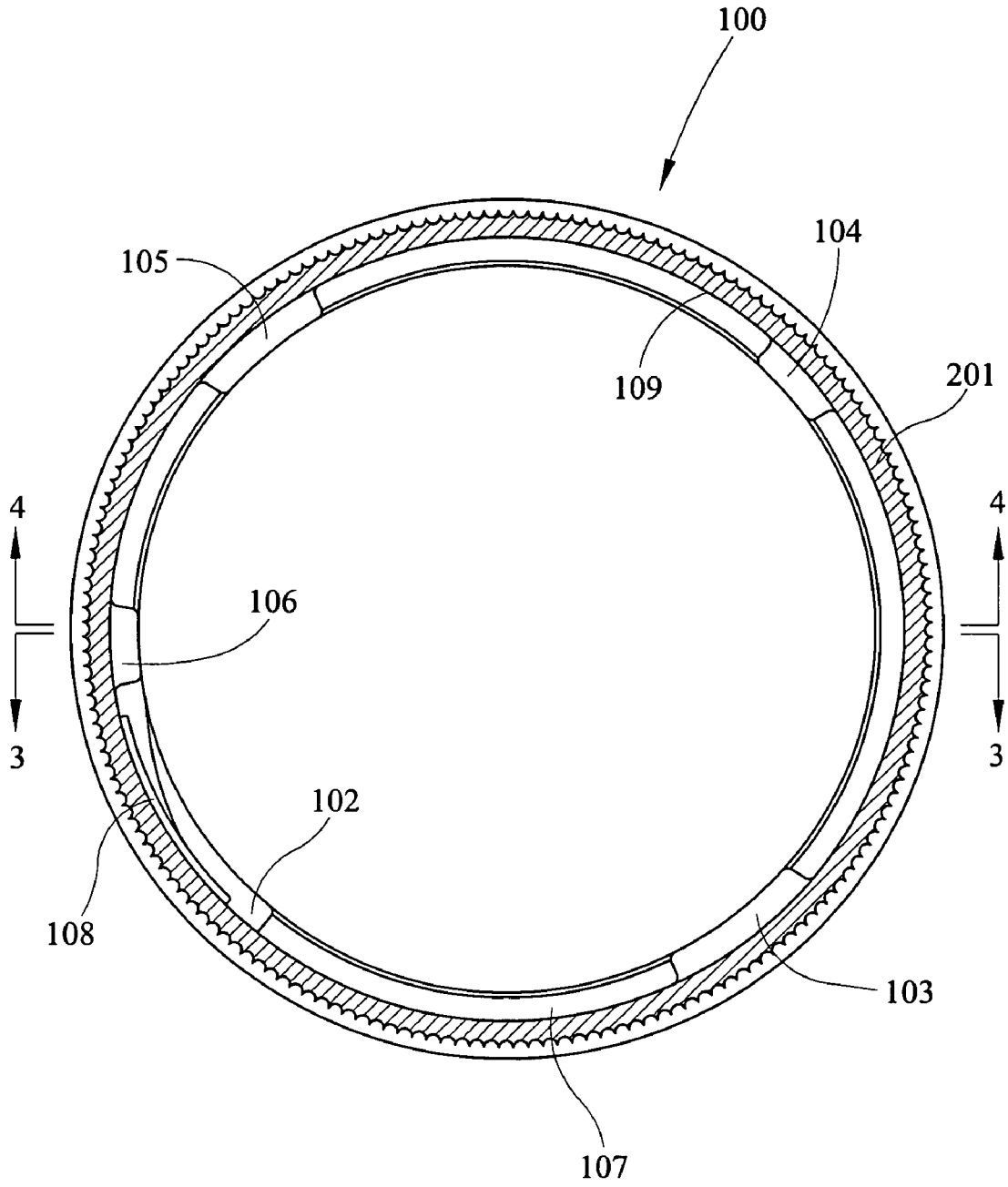
FIG. 2 is a top-sectional view of the closure of FIG. 1 showing the circumferential location of the lugs as well as the arc length of each lug.

FIG. 2 is a top-sectional view of the closure of FIG. 1 showing the circumferential location of lugs 102-106 on annular surface 109 of sidewall 201 as well as the arc length of each lug. Lugs 102-105 are positioned near 90° intervals on inner annular surface 109. This positioning provides for a uniform distribution of force on closure 100 when the lugs engage threads on a container thus preventing closure 100 from cocking or rocking on the neck of the container. However, the actual radial position of the lugs may vary from this example and such variance falls within the teaching here of.

Lug 102 has an arc length greater than the arc length of lug 103; lug 103 has an arc length greater than the arc length of 104; and lug 104 has an arc length less than the arc length of 105. These varying arc lengths provide a unique combination where the lugs exert a tightening force on a lower edge of a container thread until each lug vertically aligns with a notch in a container thread having an arc length larger than the aligning lug. When closure 100 is in a sealing position, the lugs seat in an aligning slot and provide for a child resistant closure and container combination since the closure may not be removed without a downward force pushing the lugs out of the slots. If there are no notches in a container thread, then closure 100 operates as any standard closure. Thus closure 100 may be used on standard containers where there are no notches in a thread.

Figure 3:
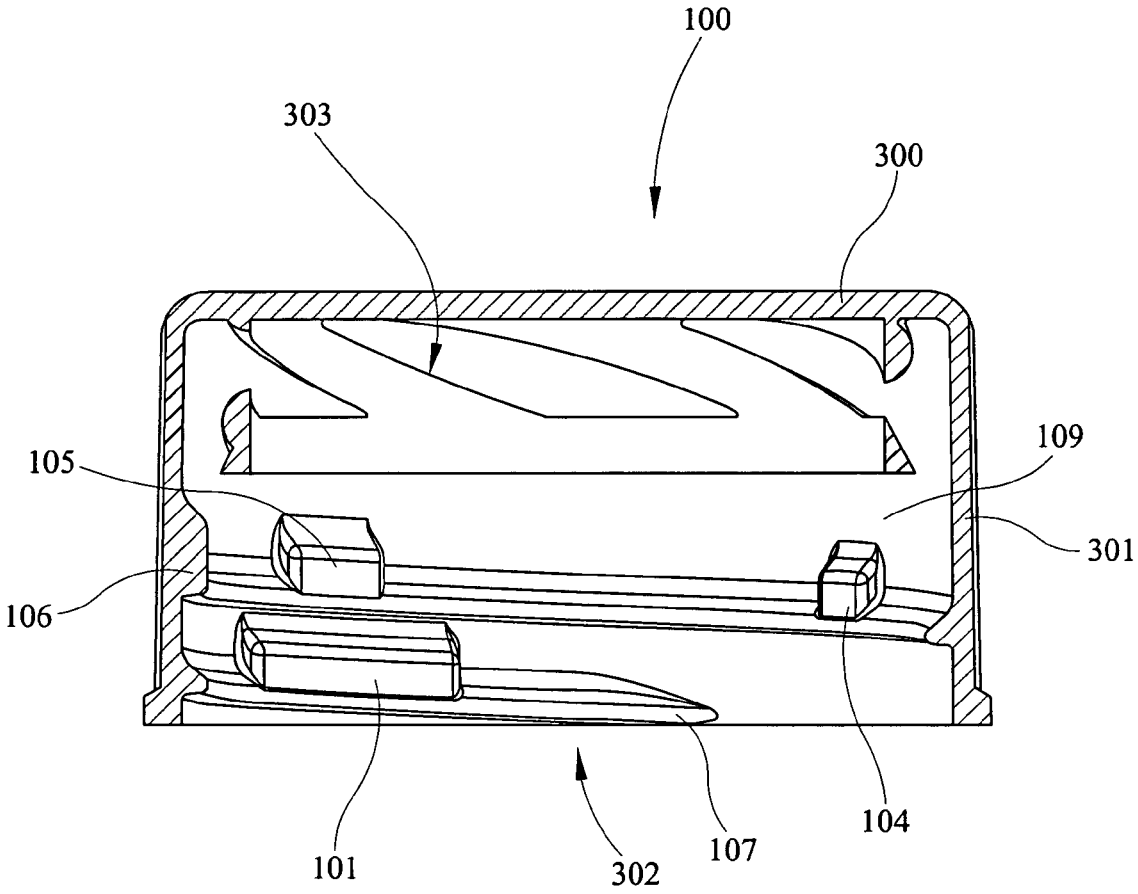
FIG. 3 is a cross-sectional view of the closure of FIG. 2 along 3-3 showing a spring in the closure.

FIG. 3 is a cross-sectional view of the closure of FIG. 2 along line 3-3 showing spring 303 on top wall 300. In this view, off-stop lug 101 is shown extending from thread 107 toward top wall 300 and being positioned near open bottom 302. Annular side wall 301 is shown having inner annular surface 109. Seating lugs 104 and 105 are also shown in this view as well as a cross-section of on-stop lug 106. Spring 303 may be any type of spring known in the art that exerts a force against closure 500 top rim or lip or other portion thereof thus providing an upward force that seats lugs 102-105 into vertically aligning notches in thread 502 or 1202 on closure 500 or 1200 since, as the closure is threaded onto the container, the spring 303 becomes compressed. This causes the closure threads to be forced upward thereby biasing the closure.

Figure 4:
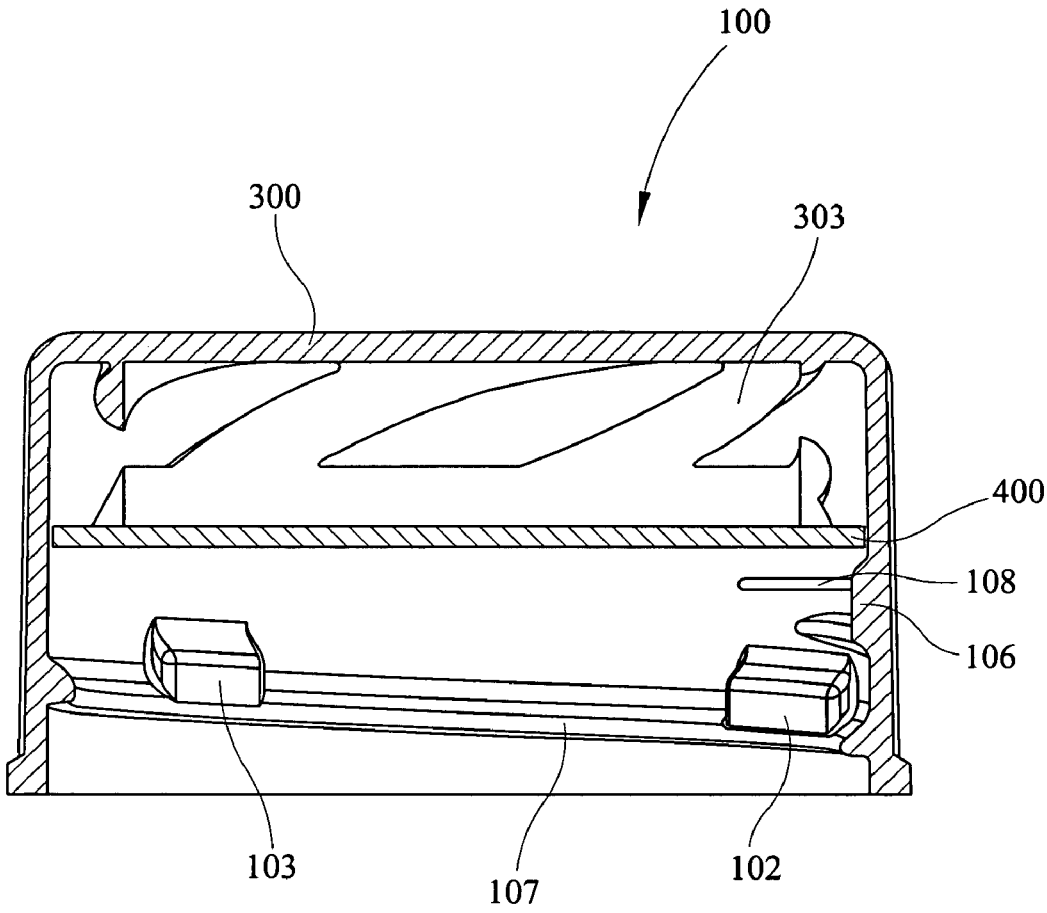
FIG. 4 is a cross-sectional view of the closure of FIG. 2 along 4-4.

FIG. 4 is a cross-sectional view of the closure of FIG. 2 along line 4-4. Shown in this view are seating lugs 102 and 103 extending from thread 107 toward top wall 300. A cross-section of on-stop lug 106 is also shown in this figure. Additionally, shown in this figure is an optional sealing disk 400 located adjacent spring 303 and above liner retention bead 108.

Figure 5:
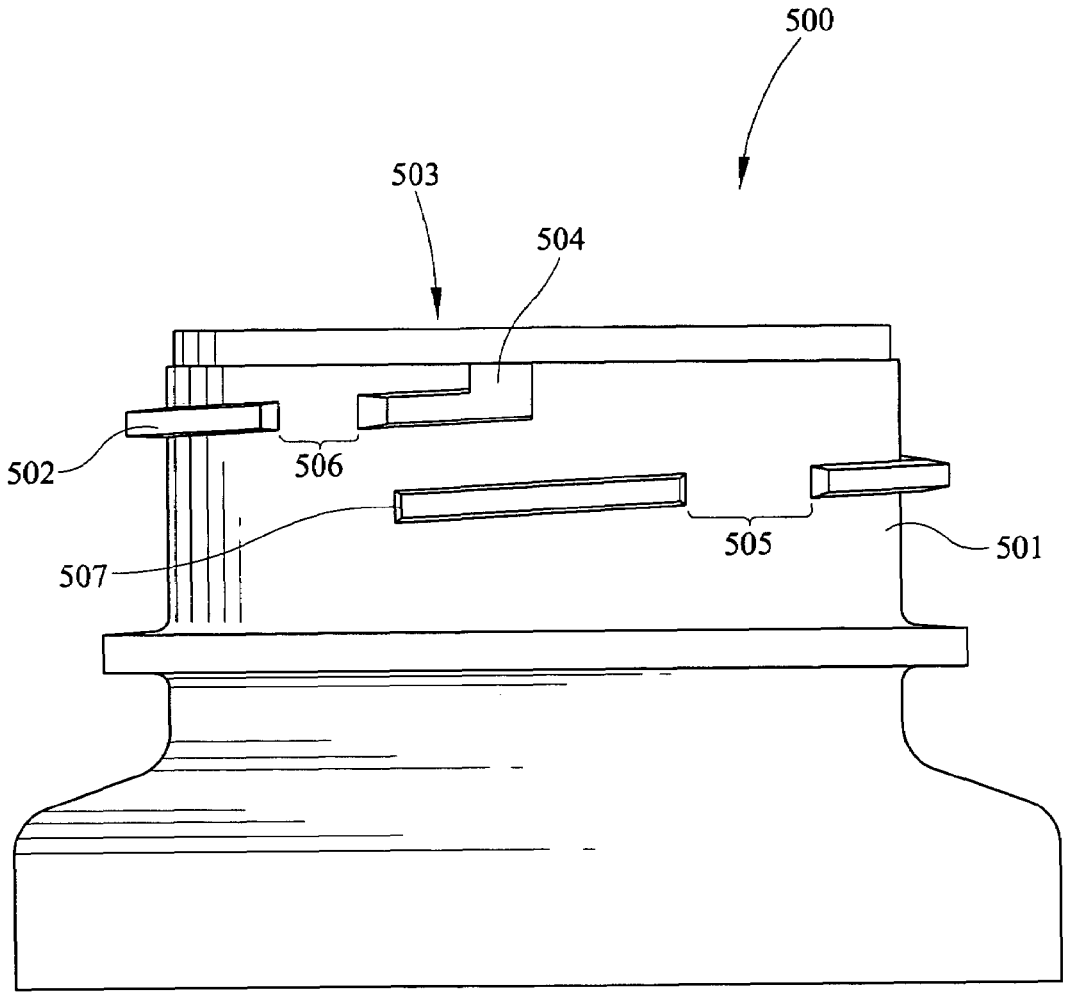
FIG. 5 is a front view of an embodiment of the container of the presently claimed invention showing notches in a thread for receiving the container lugs.

FIG. 5 is a front view of an embodiment of container 500 of the present invention showing notches 505 and 506 in thread 502 for receiving container lugs 102 and 105 respectively. Container 500 has outer annular surface or neck 501 with external thread 502 projecting outwardly there from. The lower end of thread 502 is shown as 507 and provides for a mating surface for lug 101 which acts as an off-stop when closure 100 is in a sealing position on container 500. Notch 505 in thread 502 has an arc length slightly greater than the arc length of vertically aligning lug 102 and notch 506 has an arc length slightly greater than the arc length of aligning lug 105. When closure 100 is in a sealing position on container 500, lugs 102 and 105 seat in notches 505 and 506 providing both on-stop and off-stop functionality to the combination of closure 100 and container 500. When the lugs are in a seating position in the notches, a push-and-turn child resistant closure is achieved since the closure may not be unthreaded until the lugs are forced downward out of the corresponding slots or notches. This downward force is required since the spring 303 is forcing the closure thread upwards. Also shown here is on-stop 504 which projects toward open top 503 from thread 502. When closure 100 is in sealing position on container 500, on-stop lug 106 rests adjacent to on-stop 504. Such feature is merely optional but allows definite control of the maximum on position for the closure container combination.

Figure 6:
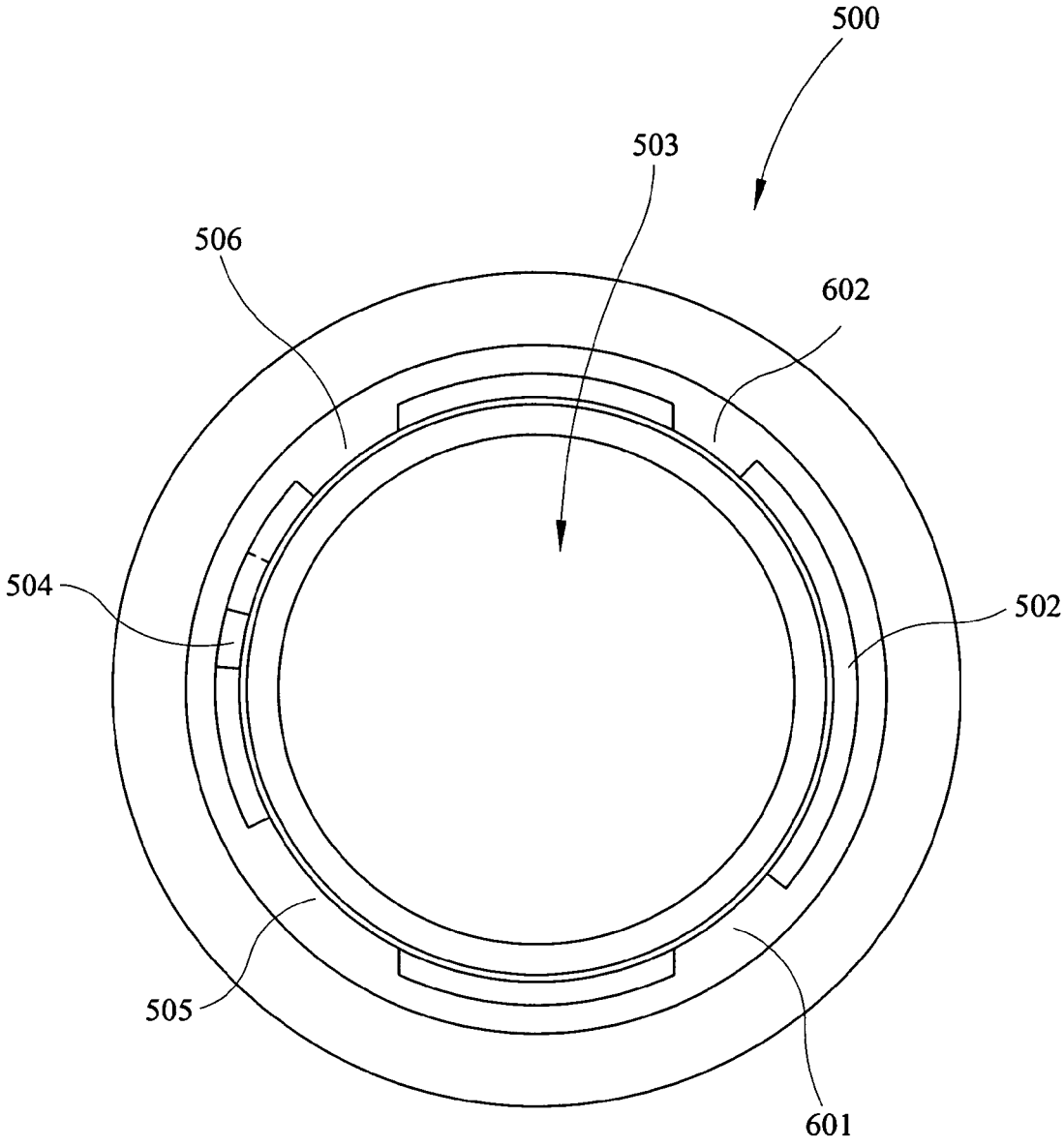
FIG. 6 is a top view of the container of FIG. 5 showing notches of specific size and orientation in the thread.

FIG. 6 is a top view of the container of FIG. 5 showing notches in thread 502 of specific size and orientation. Notch 505 has an arc length greater than aligning Lug 102; notch 601 has an arc length greater than the arc length of lug 103; notch 602 has an arc length greater than the arc length of aligning lug 104; and notch 506 has 104 has an arc length greater than the arc length of aligning lug 105. This combination of notches of specific size and orientation in thread 502 and lugs of specific size and orientation on inner annular surface 109 provides for a child resistant closure and container combination when the lugs seat in their aligning notches when closure 100 is in a sealing position on container 500.

Figure 7:
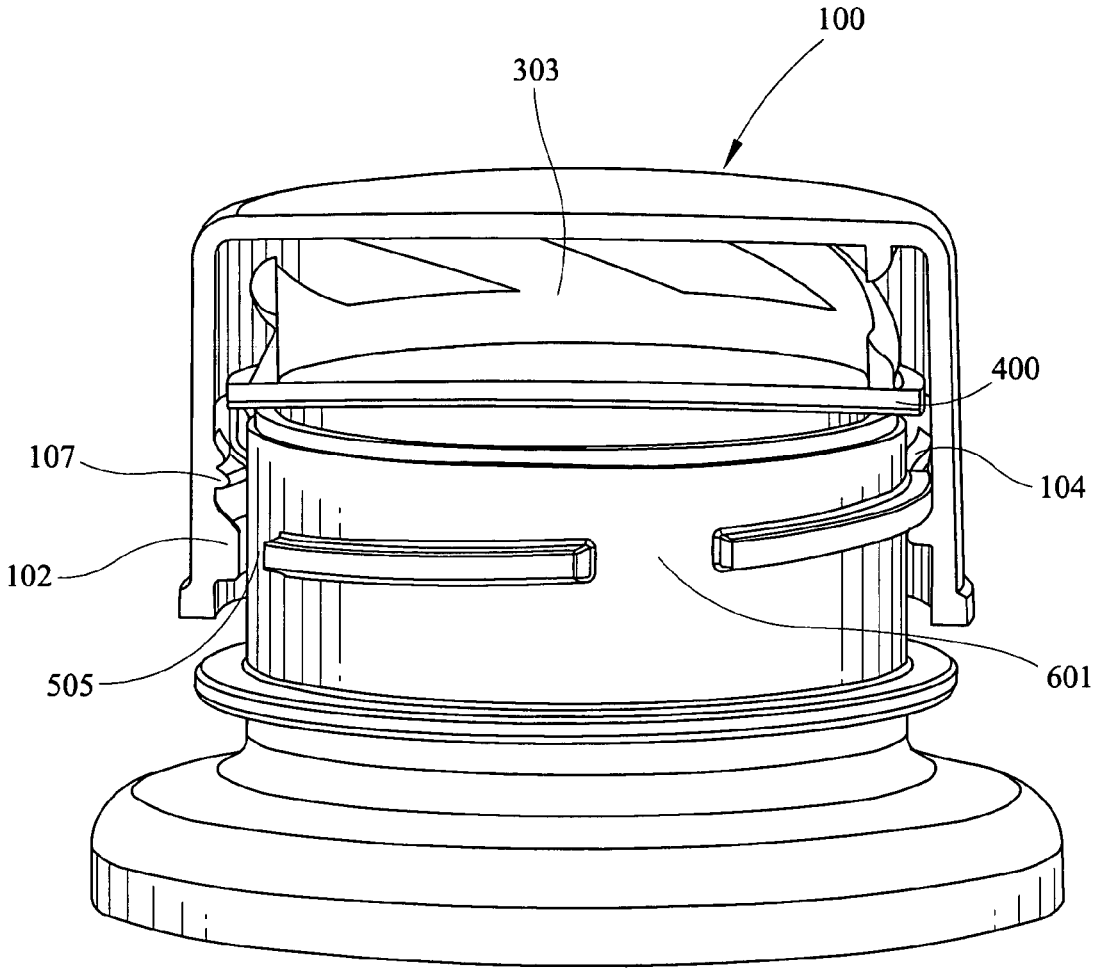
FIG. 7 is a perspective view of the container of FIG. 5 having the closure of FIG. 1, cross-sectional view, in a sealing position.

FIG. 7 is a perspective view of the container of FIG. 5 having the closure of FIG. 1, cross-sectional view, in a sealing position. Lug 104 is shown seated in notch 602. A portion of lug 102 is shown seated in notch 505. In this sealing position, spring 303 exerts an upward force on closure 100 biasing closure 100 upwards away from container 500 thus causing the lugs to seat in vertically aligning notches.

Figure 8:
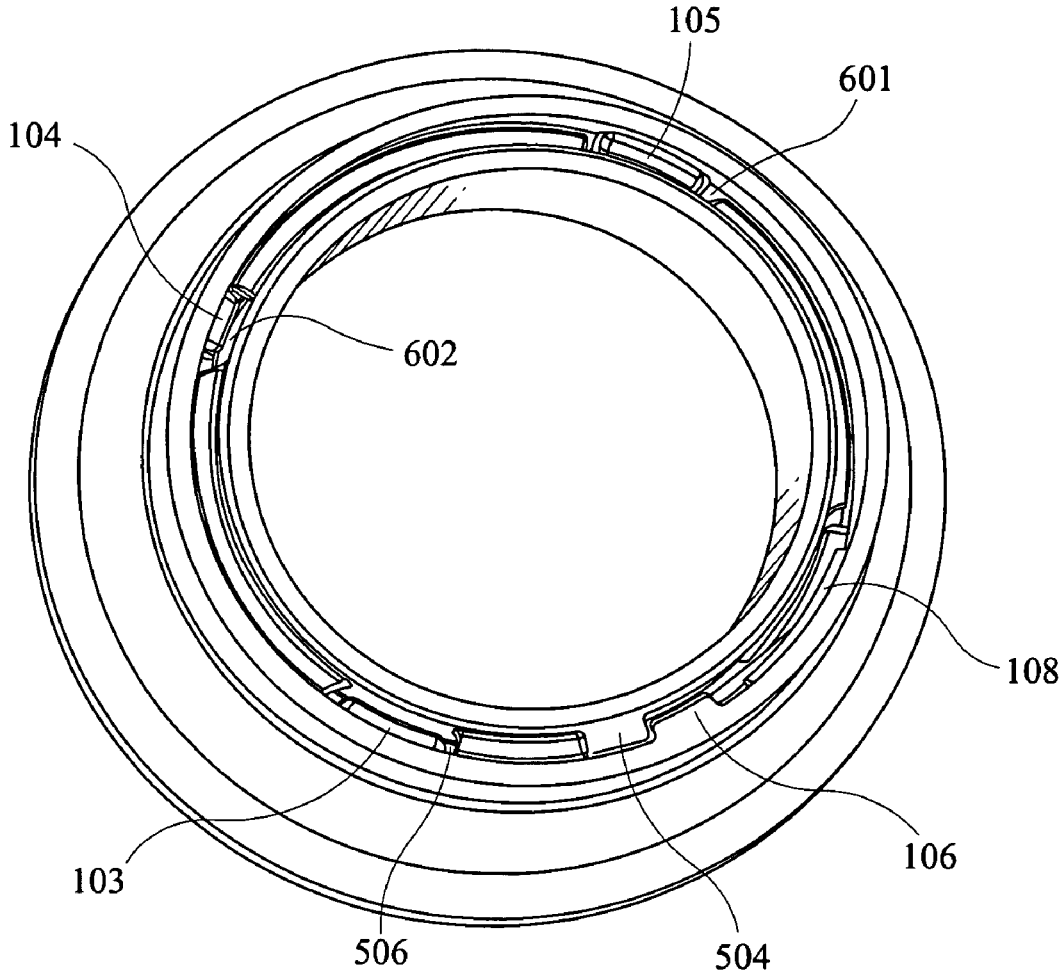
FIG. 8 is a top perspective view of the container of FIG. 5 having the closure of FIG. 1, cut-away view, in a sealing position showing the lugs seated in the notches.

FIG. 8 is a top perspective view of the container of FIG. 5 having the closure of FIG. 1, cut-away view, in a sealing position showing lugs 103-105 seated in vertically aligning notches 506, 602 and 601 respectively. Also shown here is on-stop lug 106 adjacent on-stop 504 on outer annular surface 501.

Figure 9:
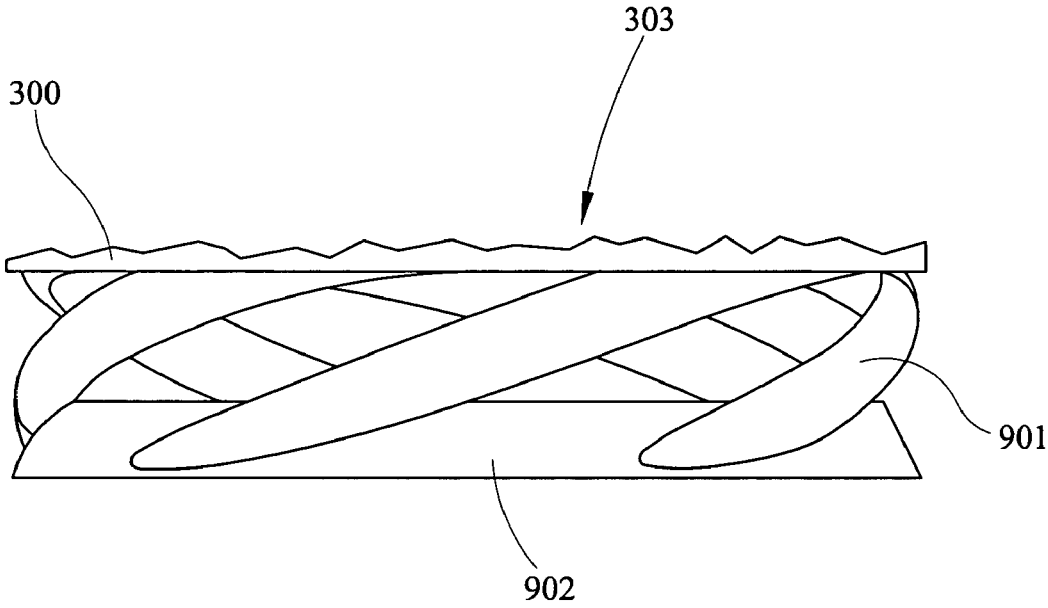
FIG. 9 is a perspective view of an embodiment of a spring located in the closure of FIG. 1.

FIG. 9 is a perspective view of an embodiment of a spring located in the closure of FIG. 3. Spring 303 is shown attached to closure top wall 300 and extending downward there from. Spring 303 has radial bands 901 which extend in a helix fashion from top wall 300 toward open bottom 302 where bands 901 connect with ring 902. When closure 100 is threadingly engaged with a container, spring 303 exerts a separating force between the closure 100 and the container. If closure 100 is threadingly engaged with container 500, then the lugs in closure 100 will seat in the slots in thread 502 upon reaching a sealing position and provide for a child resistant closure.

Figure 10:
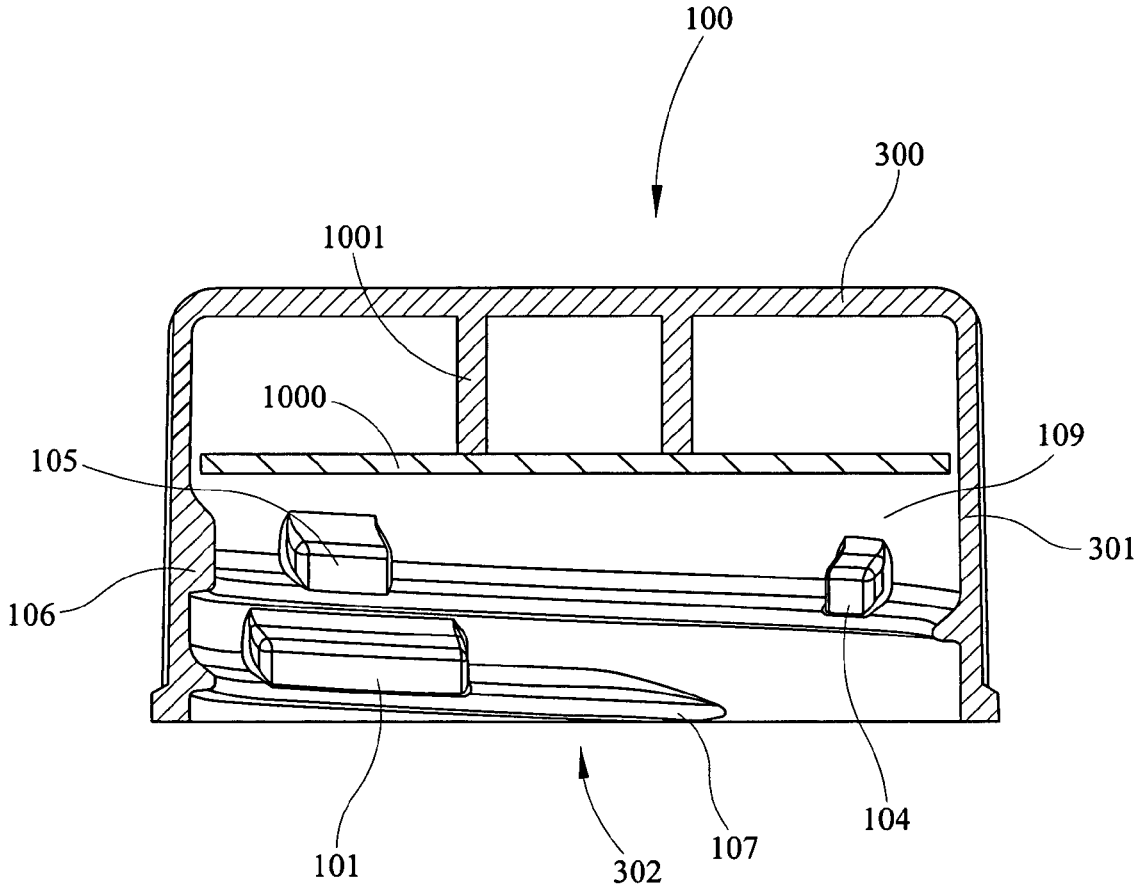
FIG. 10 is a cut-away view of an alternative embodiment of a spring located in the closure of FIG. 1.

FIG. 10 is a cut-away view of an alternative embodiment of a spring located in the a closure of the present invention. Spring 1000 is a disk shaped and comprises a material that resists the force exerted upon it when closure 100 nears a sealing position on a container thus biasing closure 100 away from container 500. Disk spring 1000 is supported by post 1001 which depends from top wall 300. It is to be understood that a variety of springs or biasing mechanisms known to a person skilled in the art may be used in the presently claimed invention.

Figure 11:
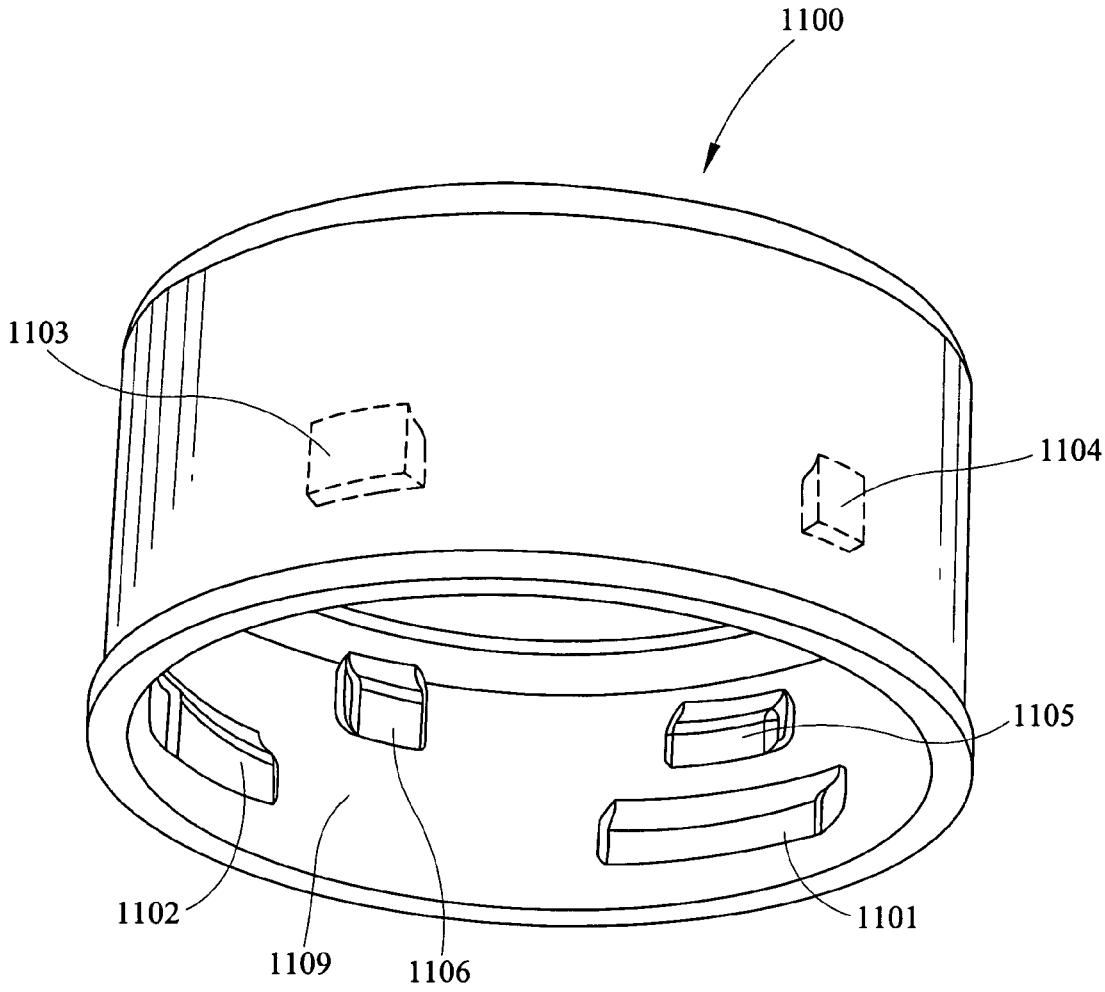
FIG. 11 is a perspective view of an embodiment of the closure of the present invention showing lugs of specific size and orientation.
Figure 12:
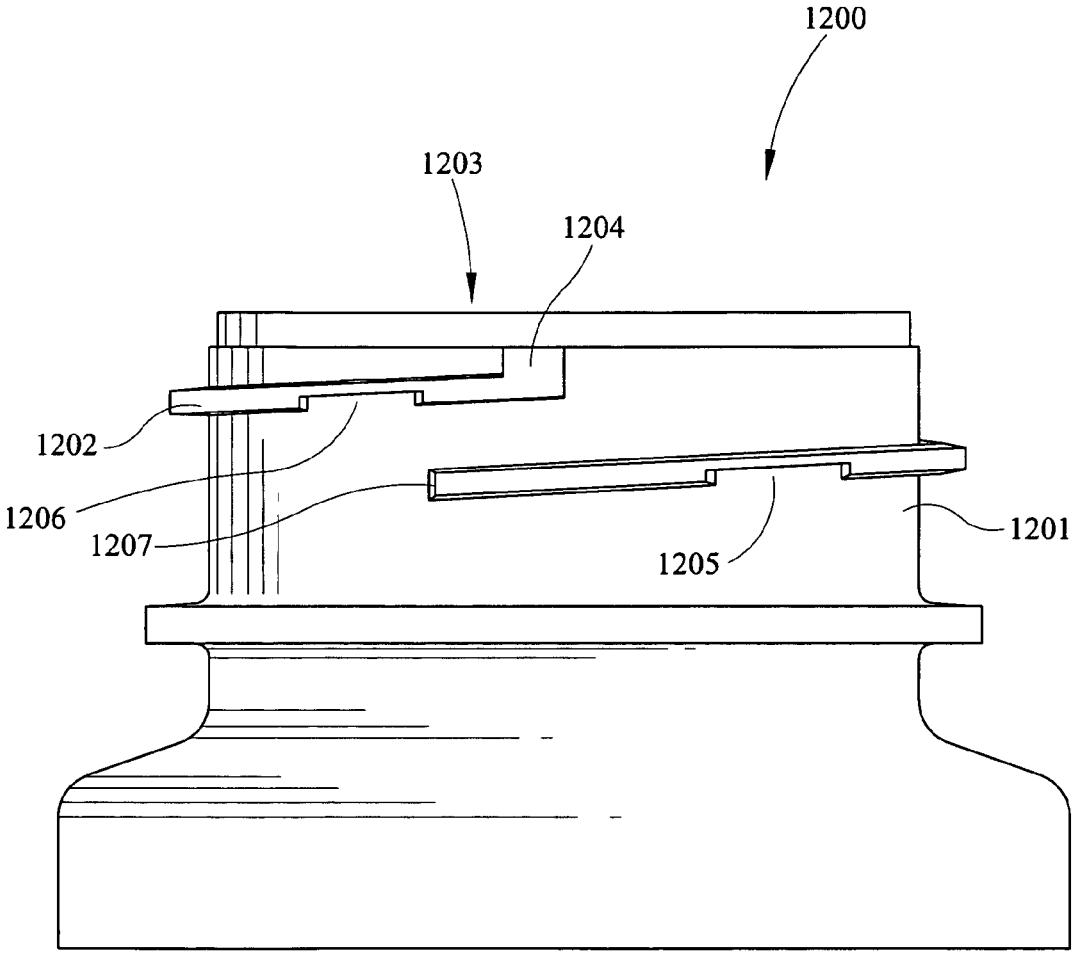
FIG. 12 is a front view of an embodiment of the container of the present invention showing notches in a thread wherein the notches have a top wall for receiving the container lugs.

FIG. 11 is a perspective view of an embodiment of the closure of the presently claimed invention showing closure 1100 having lugs 1101-1105 of specific size and orientation. FIG. 12 is a front view of an embodiment of the container of the presently claimed invention showing container 1200 having notches 1205 and 1206 (additional notches not shown) in a thread on container neck 1201 wherein the notches have a top wall for receiving container lugs 1102-1105. Lugs 1101-1106 on inner annular surface 1109 of closure 1100 act as a thread by engaging thread 1202 on container 1200. When closure 1100 is in a sealing position on container 1200 lugs 1101-1105 vertically line up with the notches in thread 1202 wherein the notches have a top wall. When closure 1100 is in a sealing position on container 1200 lugs 1102-1105 seat against the top walls of the receiving notches in thread 1202 providing a push-n-turn child resistant closure. Lug 1106 is optional and acts as a thread portion on inner annular surface 1109 and also functions as an on-stop by engaging 1204 when closure 1100 is in a sealing position on container 1200. On-stop 1204 projects toward open top 1203 from thread 1202. Lug 1101 may be optionally provided to act as an off-stop when closure 1100 is in a sealing position on container 1200. The lower end of thread 1202 is shown as 1207 and provides for a mating surface for lug 1101 which acts as on off-stop when closure 1100 is in a sealing position on container 1200. Additionally, closure 1100 and container 1200 may be used with standard threaded closures and containers of the prior art thus decreasing production and inventory problems associated with the prior art.

Figure 13:
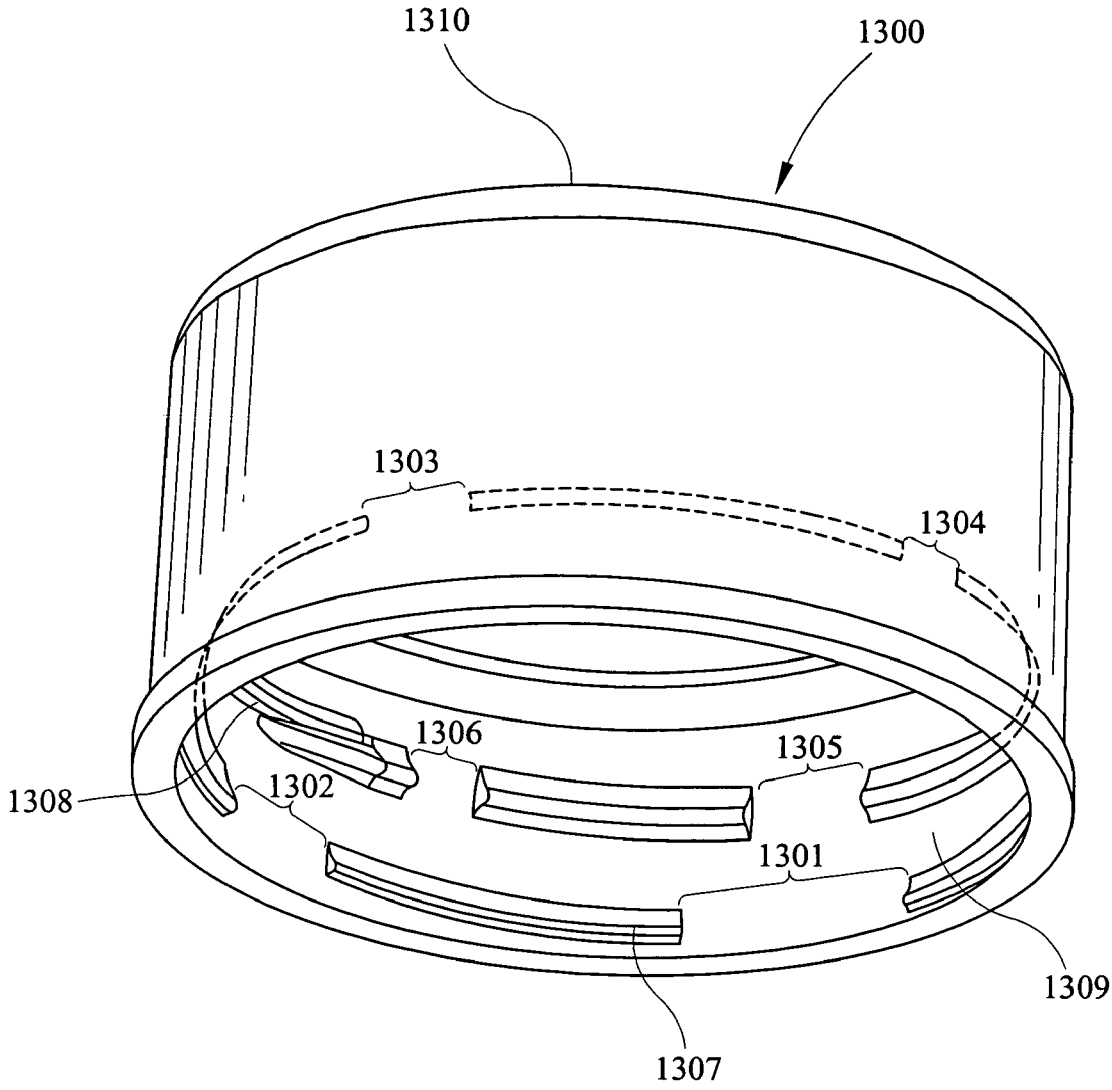
FIG. 13 is a perspective view of an embodiment of the closure of the present invention showing notches in a thread for receiving container lugs.
Figure 14:
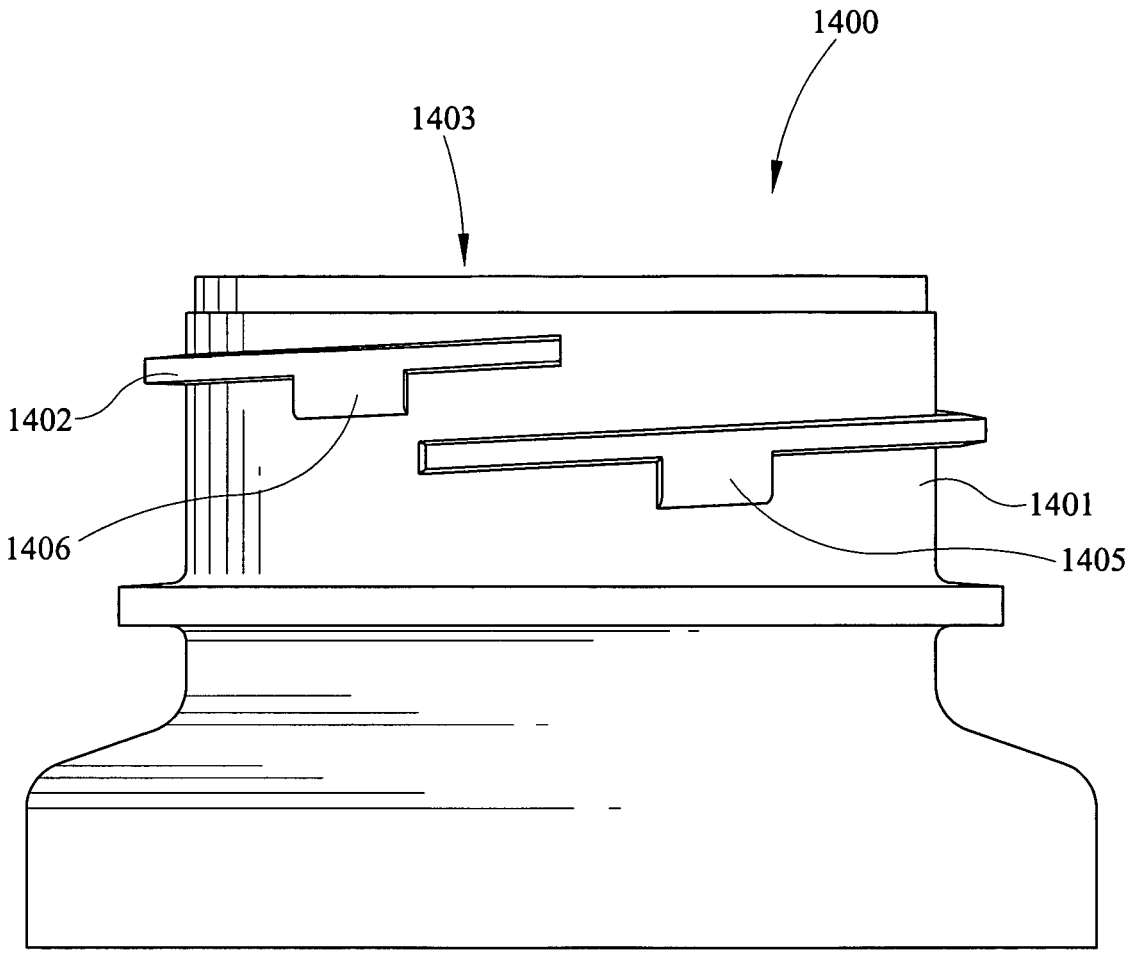
FIG. 14 is a front view of an embodiment of the container of the present invention showing lugs of specific size and orientation depending from a thread.

FIG. 13 is perspective view of closure 1300, an embodiment of the closure of the present invention, showing notches 1301-1306 in thread 1307 for receiving lugs in a container. Closure 1300 has top wall 1310 and depending annular sidewall 1309. Optional liner retention bead 1308 is also shown in this embodiment. FIG. 14 is a front view of container 1400, an embodiment of the container of the presently claimed invention, showing lugs 1405 and 1406 of specific size and orientation depending downward from thread 1402. Lugs 1405 and 1406 have a specific location on neck 1401 and have a specific arc length so that they are received in container notches 1302 and 1305 respectively when closure 1300 is in a sealing position on container 1400. Also shown here is open top 1403 in neck 1401.

A unique inventive feature of the present invention is that closure 100 will not lock with container 500 until all of the lugs vertically align with a notch in a thread having an arc length greater than the arc length of each respectively aligning lug. It is to be understood that the presently claimed invention may be practiced by having any lug and slot combination wherein at least two lugs of different arc lengths align with slots in a thread having a larger arc length than the respectively aligning lug. Such a configuration prevents the closure from locking with the container until the proper alignment is accomplished. Typically, the lug and slot combination is such that there is at least one lug not aligning with a slot having a larger arc length unless the closure is in a sealing position on the container. For example, an embodiment of the instant invention, not shown, has lugs in the inner annular surface of a closure wherein the arc length of each and every lug decreases as the lugs near the top wall of the closure. A container having slots in a thread where the arc length of each and every slot decreases as the slots near the open top of the container is also provided to cooperate with the closure having lugs with decreasing arc lengths as the lugs approach the top wall of the container.

It is to be understood that the child resistant container and closure combination of the presently claimed invention may have the lugs on the container neck and the aligning slots in a thread of the closure. The closure may have lugs or slots and the container will have the other of lugs or slots. In either configuration, the closure and container may be used with closures and/or containers having neither lugs nor slots. This interchangeable feature of the present invention provides great benefit to the production and inventory of closures and containers generally.

We claim:

1. A closure and container combination comprising:

a closure having a top wall;

a side wall depending downwardly from said top wall and defining an open bottom;

at least one internal thread projecting inwardly from an inner surface of said side wall;

at least two aligning lugs projecting upwardly from each one of said at least one internal thread on said inner surface wherein at least two of said at least two aligning lugs on each one of said at least one internal thread are of different arc lengths;

a container having a neck with an outer surface;

at least one external thread projecting outwardly from said outer surface of said neck;

at least two notches in each one of said at least one external thread wherein each of said at least two notches in each one of said at least one external thread aligns with each of said at least two aligning lugs on each one of said at least one internal thread on said closure when said closure is in a sealing position on said container neck and each of said at least two notches in each one of said at least one external thread has an arc length greater than said arc lengths of said at least two aligning lugs on each one of said at least one internal thread; and a spring depending downward from said top wall and having a lower surface aligning with said neck of said container when said closure is engaged with said container.

2. The closure of claim 1 wherein said spring has bands which extend in a helix fashion from said top wall toward said open bottom wherein said bands connect with a ring.

3. A closure and container combination comprising:

a closure having a top wall;

a side wall depending downwardly from said top wall and defining an open bottom;

one or more internal threads projecting inwardly from an inner surface of said side wall;

at least two notches in each one of said internal threads, each said notch having different arc lengths as to said other notch;

a container having a neck with an outer surface forming an open top;

one or more external threads projecting outwardly from said outer surface of said neck;

at least two lugs extending downward from each one of said external threads away from said open top on said outer surface of said neck wherein at least two of said at least two lugs on each one of said external threads have different arc lengths, each of said at least two lugs on each one of said external threads vertically align with one of said at least two notches in each one of said internal threads when said closure is in a sealing position on said container neck and each one of said at least two notches in each one of said internal threads have an arc length greater than said arc length of each of said at least two lugs on each one of said external threads as to which said one of said at least two notches in each one of said internal threads vertically align; and a spring depending downward from said top wall of said closure and having a lower surface aligning with said neck of said container when said closure is engaged with said container.

4. The closure of claim 3 wherein said spring has bands which extend in a helix fashion from said top wall toward said open bottom wherein said bands connect with a ring.

5. A closure comprising:

a top wall;

a side wall depending downwardly from said top wall and defining an open bottom;

at least one internal thread projecting inwardly from an inner surface of said side wall;

at least two lugs projecting upward from each one of said at least one internal thread toward said top wall on said inner surface wherein said at least two lugs on each one of said at least one internal thread have different arc lengths; and a spring extending from said top wall toward said open bottom.

6. The closure of claim 5 wherein said at least two lugs on each one of said at least one internal thread are of varying distances from said top wall, said at least two lugs on each one of said at least one internal thread have decreasing arc lengths as said distance from said top wall decreases.

7. A closure adapted to be threadably engaged to a container comprising:

a top wall;

a side wall having an inner surface depending downwardly from said top wall and defining an open bottom;

at least two lugs projecting inwardly in a common helical pattern from said inner surface wherein said at least two lugs are of different arc lengths and each of said at least two lugs having a top surface helical in shape, said at least two lugs are spaced from said top wall and said at least two lugs are of varying distances from said top wall, said at least two lugs have decreasing arc lengths along said common helical pattern as said distances from said top wall decreases; and a spring extending downward from said top wall.

8. A closure and container combination comprising:

a closure having a top wall;

a side wall depending downwardly from said top wall and defining an open bottom;

at least two lugs projecting inwardly in each one of at least one helical pattern from an inner surface of said side wall wherein at least two of said at least two lugs in each one of said at least one helical pattern are of different arc lengths, said at least two lugs in each one of said at least one helical pattern are spaced from at varying distances from said top wall, said at least two lugs in each one of said at least one helical pattern have decreasing arc lengths as said distance from said top wall decreases;

a container having a neck with an outer surface;

at least one external thread projecting outwardly from said outer surface of said neck;

at least two notches in each one of said at least one external thread wherein each of said at least two notches in each one of said at least one external thread aligns with each of said at least two lugs in each one of said at least one helical pattern when said closure is in a sealing position on said container neck and each of said notches in each one of said at least one external thread aligning with one of said at least two lugs in each one of said at least one helical pattern have an arc length greater than said arc length of said at least two lugs in each one of said at least one helical pattern in which said at least two notches in each one of said at least one external thread aligns; and a spring mechanism depending from said top wall of said closure toward said open bottom.

9. A closure and container combination comprising:

a closure having a top wall and a side wall depending downwardly from said top wall and defining an open bottom and one or more closure threads projecting inwardly from an inner surface of said side wall;

a container having a neck with an outer surface and one or more container threads projecting outwardly from said outer surface of said neck;

a child resistant engagement between said closure and said container wherein each one of said closure threads or each one of said container threads has at least two notches and the other of each one of said closure threads or each one of said container threads having at least two aligning lugs projecting therefrom wherein at least two of said at least two aligning lugs are of different arc lengths, and one of said at least two notches aligns with each of said at least two aligning lugs when said closure is in a sealing position on said container neck and each of said one of at least two notches has an arc length greater than said arc length of said aligning lug; and a spring mechanism within said closure biasing said closure away from said container when said closure is in a sealing position on said container neck.

10. The closure of claim 9 wherein said spring mechanism has bands which extend in a helix fashion from said top wall toward said open bottom wherein said bands connect with a ring.

11. The closure of claim 9 wherein said at least two aligning lugs extend upwardly from each one of said closure threads on said inner surface.

12. The closure of claim 11 wherein said at least two aligning lugs are positioned symmetrically about the circumference of said inner surface.

13. The closure of claim 11 having an on-stop lug extending upward from each one of said closure threads toward said top wall in said inner surface wherein said on-stop lug is in a closure proximity to said top wall than said at least two aligning lugs on each one of said closure threads.

14. The closure of claim 11 having an off-stop lug extending upward from each one of said container threads toward said top wall in said inner surface wherein said off-stop lug is in a closure proximity to said open bottom than said at least two aligning lugs on each one of said closure threads and is adjacent a lower end of each one of said container threads when said closure is in a sealing position on said container.

15. The closure of claim 9 wherein at least three aligning lugs extend upward from each one of said closure threads.

16. The closure of claim 9 having at least four aligning lugs in each one of said closure threads wherein a third aligning lug is nearer said open bottom than a fourth aligning lug and said third aligning lug has an arc length greater than said fourth aligning lug.

* * * * *

UNITED STATES PATENT AND TRADEMARK OFFICE

CERTIFICATE OF CORRECTION

PATENT NO. : 7,510,094 B1
APPLICATION NO. : 11/028939
DATED : March 31, 2009
INVENTOR(S) : Clifton C. Willis et al.

It is certified that error appears in the above-identified patent and that said Letters Patent is hereby corrected as shown below:

Column 1, line 52, insert -- . -- after "container";
Column 2, line 7, delete "closures" and insert -- closure --;
Column 5, line 37, delete "Lug" and insert -- lug --;
Column 5, line 40, delete "has 104";
Column 6, line 6, delete "a" before "closure of the...";
Column 6, line 7, delete "a" before "disk shaped...";
Column 6, line 22, delete "container" and insert -- closure --;
Column 6, line 26, delete "1101" and insert -- 1102 --;
Column 10, line 19, delete "closure" and insert -- closer --; and,
Column 10, line 24, delete "closure" and insert -- closer --.

Signed and Sealed this

Thirtieth Day of November, 2010

David J. Kappos

David J. Kappos
*Director of the United States Patent and Trademark Office*